US011507006B2

(12) United States Patent
Uzawa

(10) Patent No.: US 11,507,006 B2
(45) Date of Patent: Nov. 22, 2022

(54) POWER SUPPLY DEVICE AND IMAGE FORMING APPARATUS

(71) Applicant: CANON KABUSHIKI KAISHA, Tokyo (JP)

(72) Inventor: Hiroki Uzawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/352,707

(22) Filed: Jun. 21, 2021

(65) Prior Publication Data

US 2021/0405563 A1 Dec. 30, 2021

(30) Foreign Application Priority Data

Jun. 25, 2020 (JP) ..... JP2020-109836

(51) Int. Cl.
*G03G 15/00* (2006.01)

(52) U.S. Cl.
CPC ..... *G03G 15/5004* (2013.01); *G03G 15/80* (2013.01)

(58) Field of Classification Search
USPC ..... 399/88
See application file for complete search history.

(56) References Cited

U.S. PATENT DOCUMENTS

2004/0000897 A1* 1/2004 Asayama ..... H02M 3/33515 323/283
2013/0064566 A1* 3/2013 Kojima ..... H02M 3/33523 363/21.01
2017/0090395 A1* 3/2017 Shimura ..... H02M 3/04
2019/0163114 A1* 5/2019 Ishikawa ..... H04N 1/00076

* cited by examiner

*Primary Examiner* — Quana Grainger
(74) *Attorney, Agent, or Firm* — Canon U.S.A., Inc. IP Division

(57) ABSTRACT

A power supply device includes a first circuit and a second circuit. The first circuit includes an adjustment unit, a detection unit, a processing unit including a conversion unit, a first communication unit, and a power storage unit. The second circuit includes a second communication unit performing wireless communication with the first communication unit, and a control unit outputting a carrier wave used in the wireless communication. After outputting the carrier wave during a first period, the control unit stops output of the carrier wave during a second period. During the second period, the conversion unit operates on the power stored in the power storage unit. The control unit outputs the carrier wave during a third period after the second period. During the third period, the processing unit transmits information about a conversion result. The control unit controls the adjustment unit based on the transmitted information.

18 Claims, 10 Drawing Sheets

POWER SUPPLY DEVICE AND IMAGE FORMING APPARATUS

BACKGROUND

Field

The present disclosure relates to power supply devices controlling power supplied to loads, and to image forming apparatuses.

Description of the Related Art

In power supply devices controlling power supplied from commercial power sources to loads, there is a known configuration in which a primary circuit and a secondary circuit insulated from the primary circuit are electromagnetically coupled via an antenna.

United States Patent Application Publication No. 20190163114 discusses a configuration in which a detection unit in a primary circuit is operated on a carrier wave (power) generated at an antenna in the primary circuit due to a carrier wave output from a control unit to an antenna in a secondary circuit. The detection unit detects power (current) supplied to a load, and transmits a detection result to the control unit via the antenna. The control unit controls power supplied to the load based on the detection result transmitted from the detection unit.

A high-frequency signal is used in communication between the primary circuit and the secondary circuit, causing an electromagnetic wave due to the high-frequency signal to radiate to space. The radiating electromagnetic wave can affect a reference potential in analog-to-digital (A/D) conversion of the detected current in the primary circuit, deteriorating A/D conversion accuracy (power detection accuracy). In other words, with the detection unit and the control unit communicating with each other, the detection of power by the detection unit can cause deterioration of the A/D conversion accuracy (power detection accuracy). As a result, the accuracy of control by the control unit of the power supplied to the load can be deteriorated, causing unstable power to be supplied to the load.

SUMMARY

Various embodiments of the present disclosure prevent the power supplied to a load from becoming unstable.

According to various embodiments of the present disclosure, a power supply device is provided which includes a first circuit connected to a predetermined power supply and a second circuit insulated from the first circuit. The power supply device includes an adjustment unit in the first circuit and configured to adjust power supplied from the predetermined power supply to a load, a detection unit in the first circuit and configured to detect values of parameters relating to the power supplied to the load, a processing unit in the first circuit and including a conversion unit configured to convert the detected values of the parameters from analog values into digital values at predetermined time intervals, a first communication unit in the first circuit and connected to the processing unit, a second communication unit in the second circuit, insulated from the first communication unit, and configured to perform wireless communication with the first communication unit, a control unit in the second circuit, connected to the second communication unit, and configured to output a carrier wave used in the wireless communication to the second communication unit, and a power storage unit in the first circuit and configured to store power generated in the first communication unit and caused by the carrier wave. After the control unit outputs the carrier wave during a first period, the control unit stops output of the carrier wave during a second period. During the second period, the conversion unit operates on the power stored in the power storage unit during the first period. The control unit outputs the carrier wave during a third period after the second period. During the third period, the processing unit transmits information about a conversion result by the conversion unit during the second period, to the control unit through the wireless communication between the first communication unit and the second communication unit. The control unit controls the adjustment unit based on the transmitted information.

Further features of various embodiments of the present disclosure will become apparent from the following description of exemplary embodiments with reference to the attached drawings.

DESCRIPTION OF THE EMBODIMENTS

Some exemplary embodiments of the present invention are described below with reference to drawings. Shapes, relative positions, etc. of components described in the exemplary embodiments are to be changed as appropriate depending on a configuration of an apparatus to which the invention is applied and various conditions, and the exemplary embodiments described below are not intended to limit the scope of the present invention.

[Image Forming Apparatus]

Figure 1:
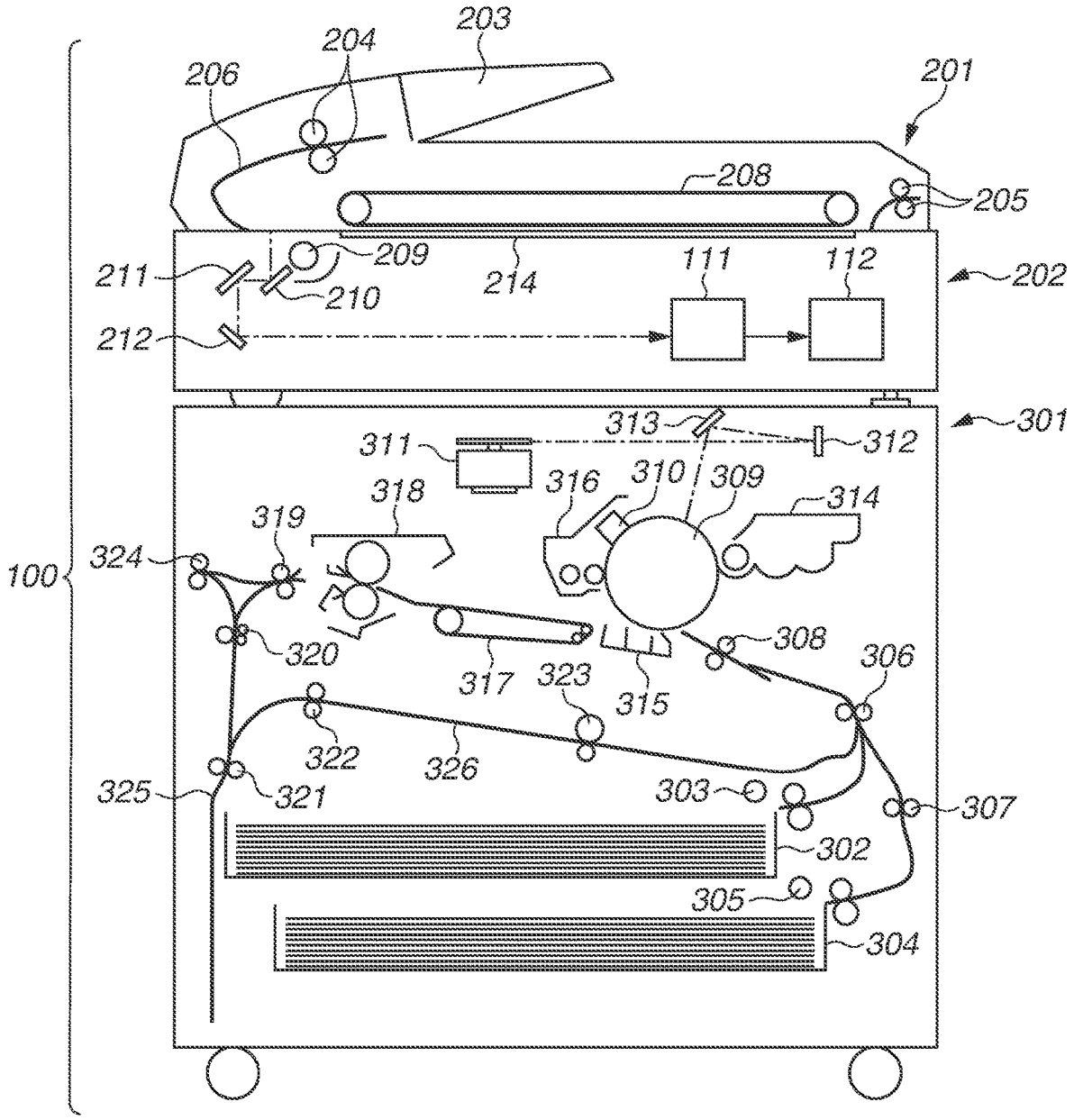
FIG. 1 is a cross-sectional view illustrating an image forming apparatus according to a first exemplary embodiment.

FIG. 1 is a cross-sectional view illustrating a configuration of a monochrome electrophotographic copier (hereinafter, referred to as image forming apparatus) 100 including a sheet conveyance apparatus used in a first exemplary embodiment. Examples of the image forming apparatus, not limited to the copier, include a facsimile apparatus, a printing apparatus, and a printer. Further, a recording system is not limited to the electrophotographic system, and for example, may be an inkjet system. Moreover, the method of forming images in the image forming apparatus may be a monochrome system or a color system.

The configuration and functions of the image forming apparatus 100 will be described with reference to FIG. 1. As illustrated in FIG. 1, the image forming apparatus 100 includes a document feeding apparatus 201, a reading apparatus 202, and an image printing apparatus 301.

Documents stacked on a document stacking unit 203 of the document feeding apparatus 201 are fed one by one by feeding rollers 204, and are conveyed along a conveyance guide 206 to a document platen glass 214 of the reading apparatus 202. Further, each of the documents is conveyed by a conveyance belt 208 at a constant speed, and is ejected by paper eject rollers 205 to an output tray (not illustrated). Light reflecting off an image on each of the documents illuminated by an illumination system 209 at a reading position of the reading apparatus 202 is guided to an image reading unit 111 by an optical system including reflection mirrors 210, 211, and 212, and is converted into image signals by the image reading unit 111. The image reading unit 111 includes a lens, a charge-coupled device (CCD) serving as a photoelectric conversion device, and a driving circuit of the CCD. The image signals output from the image reading unit 111 are subjected to various kinds of correction processing by an image processing unit 112 including a hardware device such as an application specific integrated circuit (ASIC), and resultant image signals are output to the image printing apparatus 301. Each of the documents is read in the above-described manner. In other words, the document feeding apparatus 201 and the reading apparatus 202 function as a document reading apparatus.

Document reading modes include a first reading mode and a second reading mode. In the first reading mode, an image on a document conveyed at a constant speed is read by the illumination system 209 and the optical system fixed to predetermined positions. In the second reading mode, an image on a document placed on the document platen glass 214 of the reading apparatus 202 is read by the illumination system 209 and the optical system moving at a constant speed. An image on a sheet-like document is typically read in the first reading mode, and an image in a bundled document such as a book and a booklet is typically read in the second reading mode.

Sheet storage trays 302 and 304 are provided in the image printing apparatus 301. Different types of recording media are storable in the sheet storage trays 302 and 304. For example, the sheet storage tray 302 contains sheets of A4 plain paper, and the sheet storage tray 304 contains sheets of A4 thick paper. The recording media refers to media on which images are formed by the image forming apparatus, and examples of the recording media include paper sheets, resin sheets, cloth, overhead projector (OHP) sheets, and labels.

Each of the recording media stored in the sheet storage tray 302 is fed by a feeding roller 303, and is sent to registration rollers 308 by conveyance rollers 306. Each of the recording media stored in the sheet storage tray 304 is fed by a feeding roller 305, and is sent to the registration rollers 308 by conveyance rollers 307 and the conveyance rollers 306.

The image signals output from the reading apparatus 202 are input to an optical scanning device 311 including a semiconductor laser and a polygon mirror.

The outer surface of a photosensitive drum 309 is charged by a charger 310. After that, laser beams corresponding to the image signals input from the reading apparatus 202 to the optical scanning device 311 are projected from the optical scanning device 311 on the outer surface of the photosensitive drum 309 via a polygon mirror 312 and a mirror 313, forming an electrostatic latent image on the outer surface of the photosensitive drum 309. Methods of charging the photosensitive drum 309 include methods using a corona charger or a charging roller.

Subsequently, the electrostatic latent image is developed with toner in a developing unit 314, forming a toner image on the outer surface of the photosensitive drum 309. The toner image is transferred to a recording medium by a transfer charger 315 at a position (transfer position) opposite to the photosensitive drum 309. The registration rollers 308 send the recording medium to the transfer position in synchronization with the transfer timing.

The recording medium on which the toner image has been transferred in the above-described manner is sent to a fuser 318 by a conveyance belt 317 and is heated and pressurized by the fuser 318, fixing the toner image to the recording medium. Thus, the image is formed on the recording medium by the image forming apparatus 100.

In a one-side printing mode, the recording medium having passed through the fuser 318 is ejected onto an output tray (not illustrated) by paper eject rollers 319 and 324. In a double-side printing mode, after fusing processing is performed on the surface (first surface) of the recording medium by the fuser 318, the recording medium is conveyed into an inversion path 325 by the paper eject rollers 319, conveyance rollers 320, and inversion rollers 321. The recording medium is then conveyed to the registration rollers 308 again by conveyance rollers 322 and 323, and an image is formed on a second surface of the recording medium by the above-described method. The recording medium is then ejected onto the output tray (not illustrated) by the paper eject rollers 319 and 324.

To eject the recording medium with the image on the first surface face-down out of the image forming apparatus 100, the recording medium through the fuser 318 is conveyed in the direction toward the conveyance rollers 320 via the paper eject rollers 319. The conveyance rollers 320 are then reversed immediately before the trailing edge of the recording medium passes through the nip portion of the conveyance rollers 320, and the recording medium with the first surface of the recording medium facing downward is ejected out of the image forming apparatus 100 through the paper eject rollers 324.

Above is the description of the configuration and the functions of the image forming apparatus 100.

Figure 2:
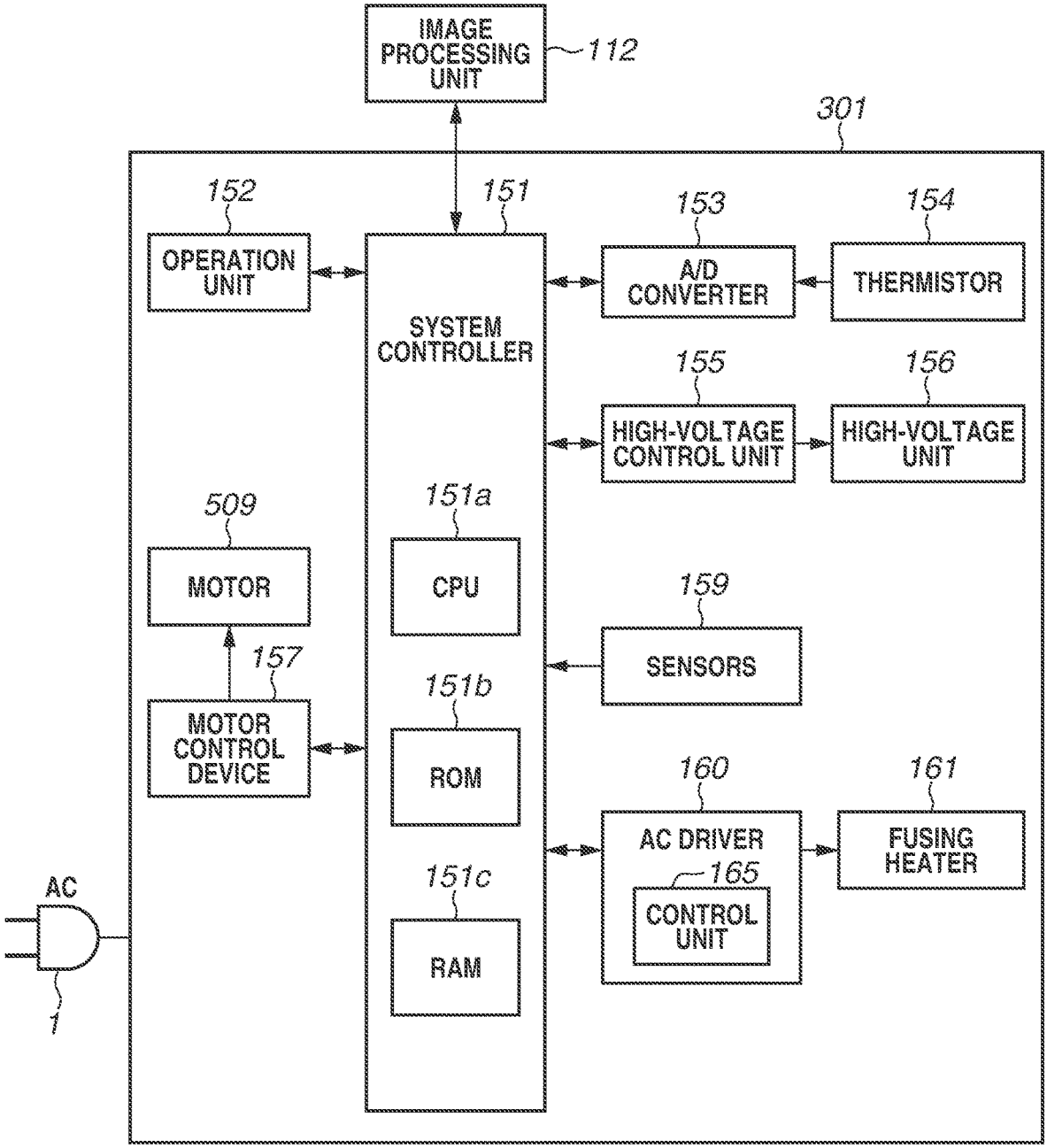
FIG. 2 is a block diagram illustrating a control configuration of the image forming apparatus according to the first exemplary embodiment.

FIG. 2 is a block diagram illustrating an example of a control configuration of the image forming apparatus 100. As illustrated in FIG. 2, the image forming apparatus 100 is connected to an alternating-current power supply 1 (AC) as a commercial power supply, and various kinds of devices in the image forming apparatus 100 operate on power supplied from the alternating-current power supply 1. As illustrated in FIG. 2, a system controller 151 includes a central processing unit (CPU) 151*a*, a read only memory (ROM) 151*b*, and a random access memory (RAM) 151*c*. The system controller 151 is connected to the image processing unit 112, an operation unit 152, an analog-to-digital (A/D) converter 153, a high-voltage control unit 155, a motor control device 157, sensors 159, and an AC driver 160. Data and commands are transmittable and receivable between the connected units and the system controller 151.

The CPU 151*a* reads out and runs various kinds of programs stored in the ROM 151*b*, to perform various kinds of sequences relating to a predetermined image forming sequence.

The RAM 151*c* is a storage device. The RAM 151*c* stores various kinds of data such as values set for the high-voltage control unit 155, instruction values to the motor control device 157, and information received from the operation unit 152.

The system controller 151 transmits to the image processing unit 112 setting value data for various kinds of devices in the image forming apparatus 100 used in image processing by the image processing unit 112. Further, the system controller 151 receives signals from the sensors 159, and sets setting values for the high-voltage control unit 155 based on the received signals.

The high-voltage control unit 155 supplies a voltage to a high-voltage unit 156 (e.g., charger 310, developing unit 314, and transfer charger 315) based on the setting values set by the system controller 151.

The motor control device 157 controls a motor driving loads provided in the image forming apparatus 100 based on instructions output from the CPU 151*a*. In FIG. 2, only a motor 509 is depicted as the motor of the image forming apparatus 100; in reality, a plurality of motors however is provided in the image forming apparatus 100. In some embodiments, one motor control device controls a plurality of motors. In FIG. 2, only one motor control device is provided; however, two or more motor control devices may be provided in the image forming apparatus 100.

The A/D converter 153 receives a detection signal detected by a thermistor 154 detecting temperatures of a fusing heater 161, converts the detection signal from an analog signal into a digital signal, and transmits the digital signal to the system controller 151. The system controller 151 controls the AC driver 160 based on the digital signal received from the A/D converter 153. The AC driver 160 controls the fusing heater 161 for the fusing heater 161 to have a temperature for fusing processing. The fusing heater 161 is a heater used in the fusing processing and is included in the fuser 318.

The system controller 151 controls the operation unit 152 to display an operation screen operated by a user to set, for example, a type of a recording medium used (hereinafter, referred to as sheet type), on a display unit in the operation unit 152. The system controller 151 receives information set by the user from the operation unit 152, and operates an operation sequence of the image forming apparatus 100 based on the information set by the user. In addition, the system controller 151 transmits information representing a status of the image forming apparatus 100, to the operation unit 152. The information representing a status of the image forming apparatus 100 includes the number of image formation sheets, a progress status of the image forming operation, and jam and multi-feeding of sheets in the document feeding apparatus 201 and the image printing apparatus 301. The operation unit 152 displays the information received from the system controller 151 on the display unit.

The system controller 151 controls an operation sequence of the image forming apparatus 100 in the above-described manner.

[AC Driver]

Figure 3:
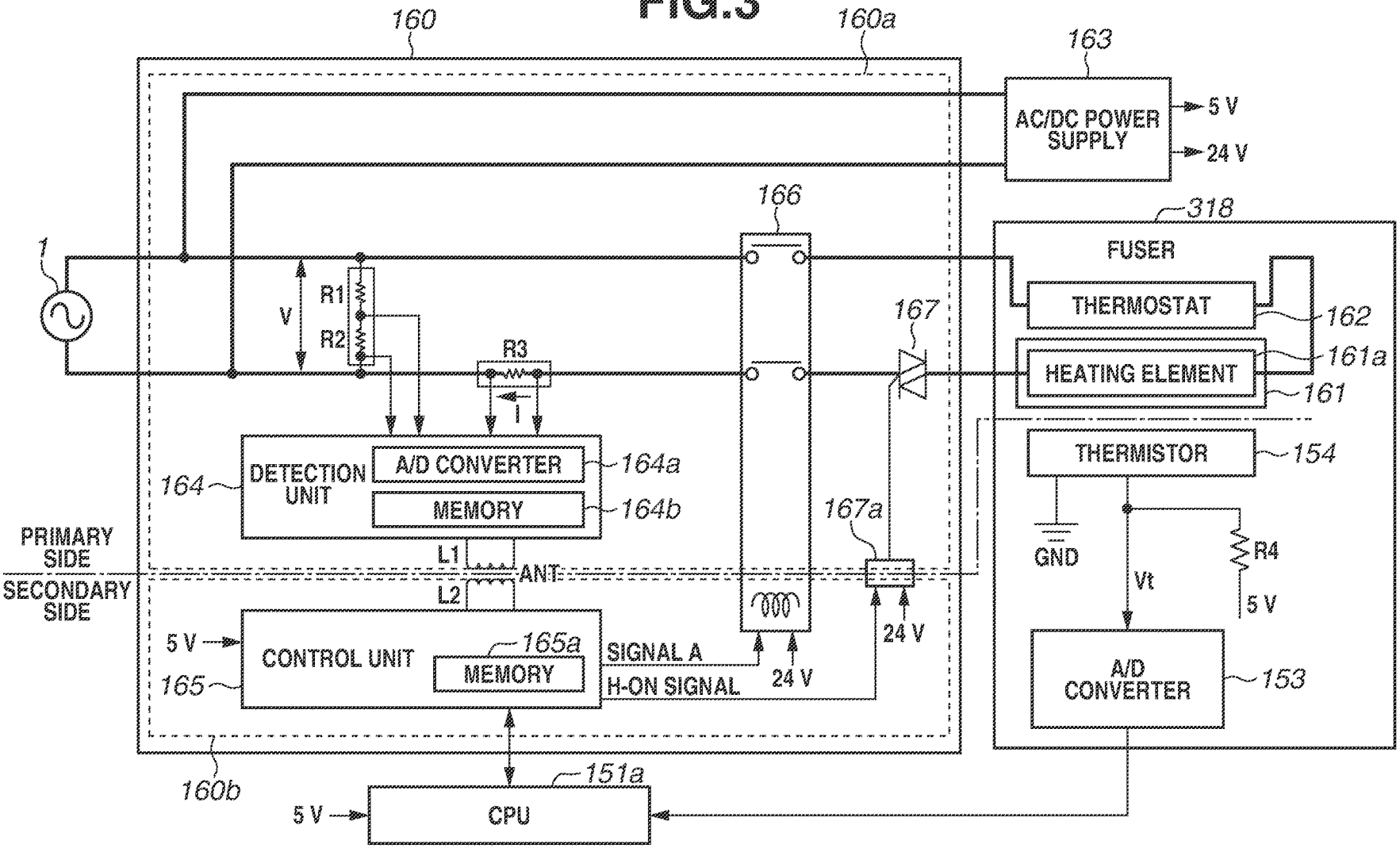
FIG. 3 is a control block diagram illustrating a configuration of an alternating-current (AC) driver according to the first exemplary embodiment.

FIG. 3 is a control block diagram illustrating a configuration of the AC driver. The AC driver 160 includes a first circuit 160*a* connected to the alternating-current power supply 1, and a second circuit 160*b* insulated from the first circuit 160*a*. As illustrated in FIG. 3, the first circuit 160*a* is included in a primary side of the AC driver 160, and the second circuit 160*b* is included in a secondary side of the AC driver 160.

The AC driver 160 includes a detection unit 164, a relay circuit 166, a triac 167, and a control unit 165. The detection unit 164 serves as a processing unit to detect a voltage V supplied from the alternating-current power supply 1 and a current I flowing through the fusing heater 161. The relay circuit 166 controls power supply from the alternating-current power supply 1 to the fuser 318. The triac 167 serves as an adjustment unit. The control unit 165 controls the relay circuit 166 and the triac 167.

As illustrated in FIG. 3, the detection unit 164 is insulated from the control unit 165, the detection unit 164 is provided in the first circuit 160*a*, and the control unit 165 is provided in the second circuit 160*b*. The detection unit 164 is electromagnetically coupled to the control unit 165 via an antenna ANT. Further, the control unit 165 is connected to the CPU 151*a* and controlled by the CPU 151*a*. The antenna ANT will be described below.

As illustrated in FIG. 3, the voltage output from the alternating-current power supply 1 is also input to an AC/DC power supply 163. The AC/DC power supply 163 converts the alternating-current voltage output from the alternating-current power supply 1 into direct-current voltages of, for example, 5 volts and 24 volts, and outputs the direct-current voltages. A direct-current voltage of 5 volts is supplied to the CPU 151*a* and the control unit 165. A direct-current voltage of 24 volts is supplied to the relay circuit 166 and a triac driving circuit 167*a*. Direct-current voltages of 5 volts and 24 volts are also supplied to various kinds of devices in the image forming apparatus 100. The voltages output from the AC/DC power supply 163 are not supplied to the detection unit 164. The detection unit 164 insulated from the control unit 165 is supplied with power from the control unit 165 via the antenna ANT. A specific configuration will be described below.

The relay circuit 166 is controlled by a signal A output from the control unit 165. For example, if a signal A='H' is output from the control unit 165, the relay circuit 166 is controlled to supply power from the alternating-current power supply 1 to the fuser 318. If the signal A='L' is output from the control unit 165, the relay circuit 166 is controlled to interrupt power supplied from the alternating-current power supply 1 to the fuser 318. For example, if the current flowing through the fusing heater 161 becomes higher than a predetermined value (i.e., in an abnormal state), the signal A='L' is output to the relay circuit 166. The control unit 165 outputs the signal A in response to an instruction from the CPU 151*a*.

Figure 4:
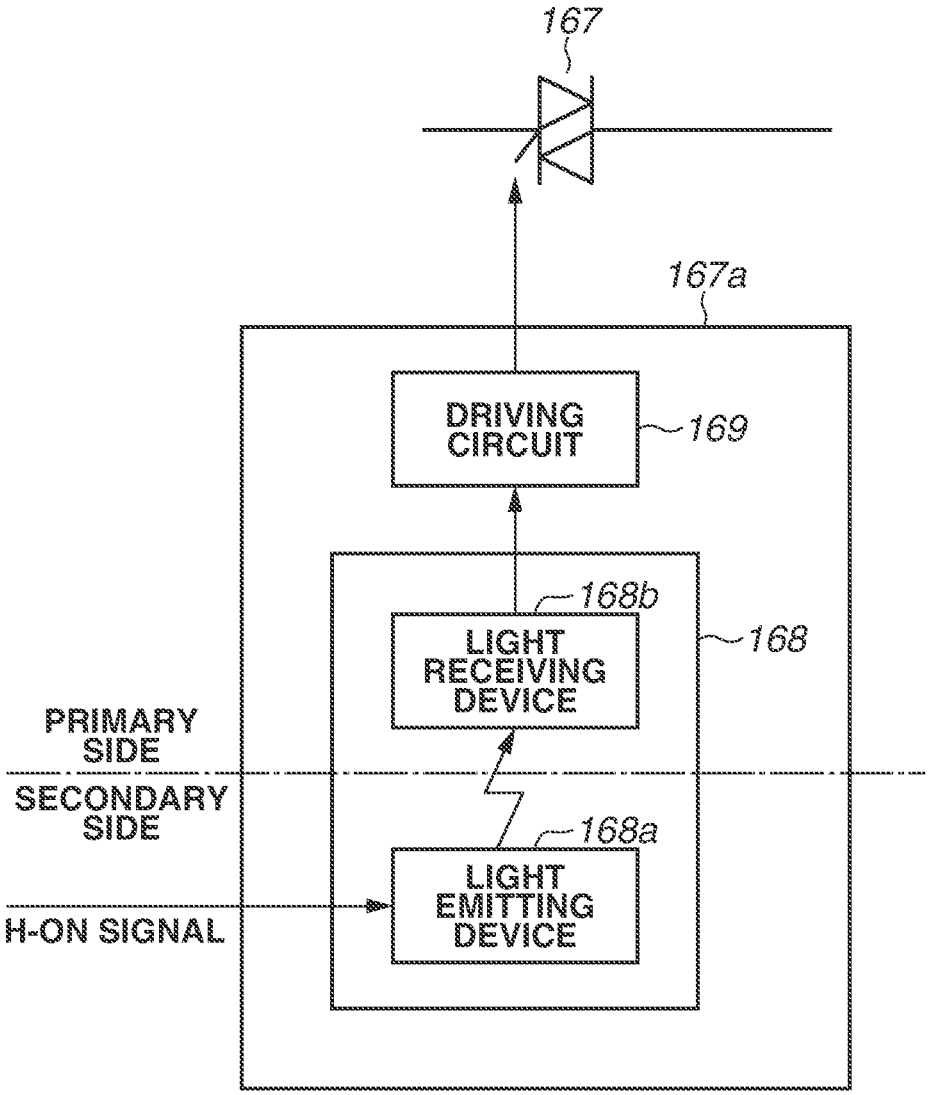
FIG. 4 is a block diagram illustrating a configuration of a triac driving circuit.

The triac driving circuit 167*a* is a circuit to control the triac 167. FIG. 4 is a block diagram illustrating a configuration of the triac driving circuit 167*a*. As illustrated in FIG. 4, the triac driving circuit 167*a* includes a photocoupler 168 and a driving circuit 169. The photocoupler 168 includes a light emitting device 168*a* provided in the second circuit 160*b*, and a light receiving device 168*b* provided in the first circuit 160*a*. The driving circuit 169 drives the triac 167 based on a light reception result of the light receiving device 168*b*.

If the H-ON signal='H' is output from the control unit 165, the light emitting device 168*a* in the triac driving circuit 167*a* emits light. If the light receiving device 168*b* in the triac driving circuit 167*a* receives the light emitted from the light emitting device 168*a*, the driving circuit 169 drives the triac 167 to turn on the triac 167. As described above, the triac 167 of the first circuit 160*a* is controllable by the second circuit 160*b* while insulation between the first circuit 160*a* and the second circuit 160*b* is maintained.

Through the above-mentioned control of the triac 167, the power is supplied to the fusing heater 161. The amount of the power supplied to the fusing heater 161 is adjusted by the control of the timing that the triac 167 is turned on.

<Temperature Control of Fusing Heater>

A method of controlling the temperature of the fusing heater 161 will be described. Power output from the alternating-current power supply 1 is supplied to a heating element 161*a* in the fusing heater 161 provided in the fuser 318, through the AC driver 160.

The control unit 165 transmits a command to instruct the start of detecting the current I and the voltage V to the detection unit 164 via the antenna ANT, at each predetermined control period T_cont. A method of transmitting the command will be described. In the present exemplary embodiment, the predetermined control period T_cont is the same as the period of the alternating-current voltage; however, the predetermined control period T_cont is not limited thereto. For example, it is suitable that the predetermined control period T_cont is a period greater than or equal to the period of the alternating-current voltage.

As illustrated in FIG. 3, a voltage V (a voltage across a resistor R2) supplied from the alternating-current power supply 1 and a voltage across a resistor R3 (i.e., current I flowing through the heating element 161*a*) are input to the A/D converter 164*a* serving as a conversion unit provided in the detection unit 164, and are converted from analog values into digital values at predetermined time intervals (e.g., 50 μs).

When receiving the command to instruct the start of detecting the current I and the voltage V, the detection unit 164 notifies the control unit 165 of the reception of the command via the antenna ANT. In addition, the detection unit 164 detects timings (hereinafter, referred to as zero cross timings) that the voltage V changes from a negative value to a positive value. When a zero cross timing is detected, the detection unit 164 performs integral calculations of V^2, I^2, and V*I as represented by the following expressions (1) to (3) based on values output from the A/D converter 164*a*.

[Expression 1]

$$\Sigma V(n)^2 \tag{1}$$

$$\Sigma I(n)^2 \tag{2}$$

$$\Sigma V(n)I(n) \tag{3}$$

The detection unit 164 stores calculated integral values in the memory 164*b* as a storage unit.

When receiving a command to request the detection result from the control unit 165 via the antenna ANT, the detection unit 164 calculates an effective value Vrms of the voltage V, an effective value Irms of the current I, and an effective value Prms of the power V*I(=P) by using the following expressions (4) to (6).

[Expression 2]

$$Vrms = \sqrt{\frac{1}{N}\sum_{n=1}^{N} V(n)^2} \tag{4}$$

$$Irms = \sqrt{\frac{1}{N}\sum_{n=1}^{N} I(n)^2} \tag{5}$$

-continued $$Prms = \frac{1}{N}\sum_{n=1}^{N} V(n)I(n) \tag{6}$$

The detection unit 164 stores the calculated effective values Vrms, Irms, and Prms in the memory 164*b*, and transmits the effective values Vrms, Irms, and Prms as a detection result (conversion result) to the control unit 165. The detection unit 164 outputs a signal ZX representing a zero cross timing to the control unit 165 via the antenna ANT every detection of a zero cross. The detection unit 164 resets the integral values of V^2, I^2, and V*I stored in the memory 164*b* every calculation of the effective values Vrms, Irms, and Prms.

The control unit 165 stores the effective values Vrms, Irms, and Prms acquired from the detection unit 164, in the memory 165*a*. Further, the control unit 165 outputs a signal ZX to the CPU 151*a*.

The CPU 151*a* acquires the effective values Vrms, Irms, and Prms stored in the memory 165*a* of the control unit 165, at each predetermined control period T_cont.

The fuser 318 includes a thermostat 162. The thermostat 162 has the functionality to stop power from being supplied to the heating element 161*a* in response to the temperature of the thermostat 162 reaching a predetermined temperature.

A thermistor 154 to detect the temperature of the fusing heater 161 is provided near the fusing heater 161. As illustrated in FIG. 3, the thermistor 154 is connected to the ground (GND). The thermistor 154 has characteristics in which, for example, the resistance value decreases as the temperature increases. The variation in temperature of the thermistor 154 affects a voltage Vt across the thermistor 154. The detection of the voltage Vt allows the temperature of the fusing heater 161 to be detected.

The voltage Vt as an analog signal output from the thermistor 154 is input to the A/D converter 153. The A/D converter 153 converts the voltage Vt from the analog signal into a digital signal, and outputs the digital signal to the CPU 151*a*.

The CPU 151*a* controls the temperature of the fusing heater 161 by controlling the triac 167 through the control unit 165 based on the effective values Vrms, Irms, and Prms acquired from the control unit 165 and the voltage Vt output from the A/D converter 153. The following is a description of a specific method of controlling the temperature of the fusing heater 161.

Figure 5:
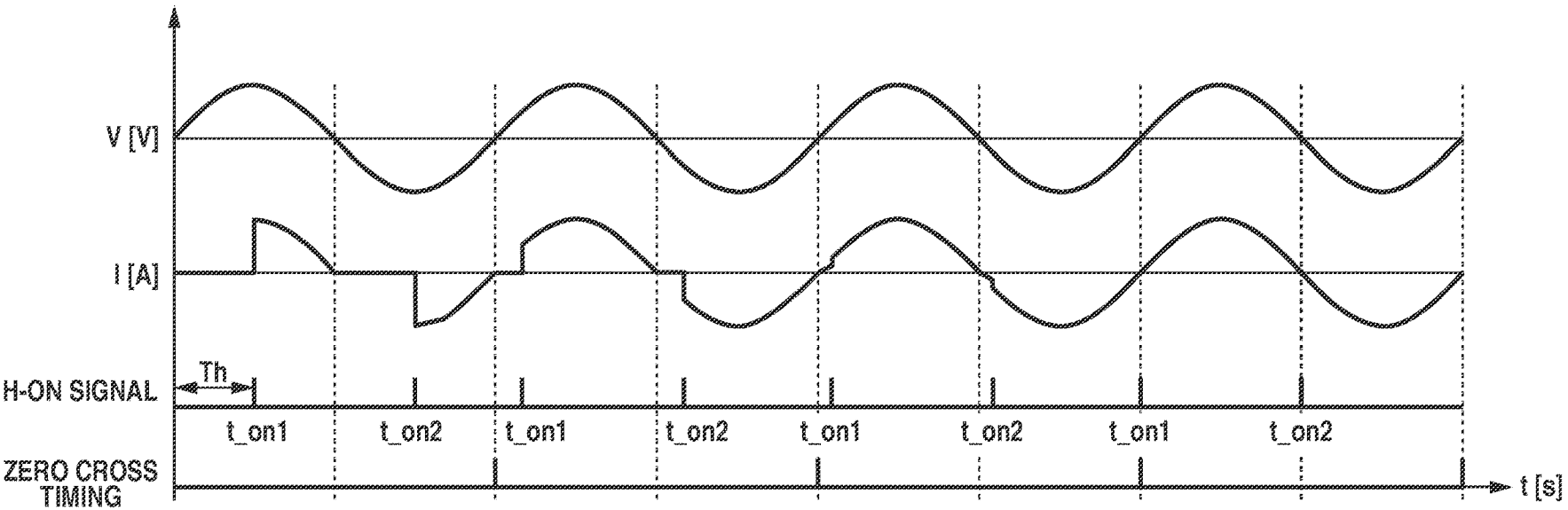
FIG. 5 is a time chart illustrating voltage V of an alternating-current power supply, current flowing through a heating element, H-ON signals output from a control unit, and zero cross timings.

FIG. 5 is a time chart illustrating a voltage V of the alternating-current power supply 1, a current I flowing through the heating element 161*a*, H-ON signals output from the control unit 165, and zero cross timings. As illustrated in FIG. 5, a period Tzx of the zero cross timing corresponds to the period of the voltage of the alternating-current power supply 1.

As illustrated in FIG. 5, by a period Th from the zero cross timing to a timing t_on1 of a H-ON signal='H' being controlled, the amount of the current (amount of supplied power) flowing through the heating element 161*a* is controlled. More specifically, for example, the amount of the current flowing through the heating element 161*a* increases as the period Th becomes shorter. In other words, as the period Th is controlled to decrease, the temperature of the fusing heater 161 increases.

In the present exemplary embodiment, the CPU 151*a* controls the amount of the current flowing through the heating element 161*a* by controlling the period from the zero cross timing to the timing t_on1 through the control unit 165. As a result, the CPU 151*a* controls the temperature of the fusing heater 161. In the present exemplary embodiment, the triac 167 is controlled so that a current of the same amount as that of the current flowing caused by the output of the H-ON signal='H' at the timing t_on1 but with the opposite polarity to that of the current flows through the heating element 161*a*. More specifically, as illustrated in FIG. 5, the H-ON signal='H' is output at a timing t_on2 after a period Tzx/2 has passed since the timing t_on1 (i.e., the timing after half the period of voltage of alternating-current power supply 1).

Figure 6:
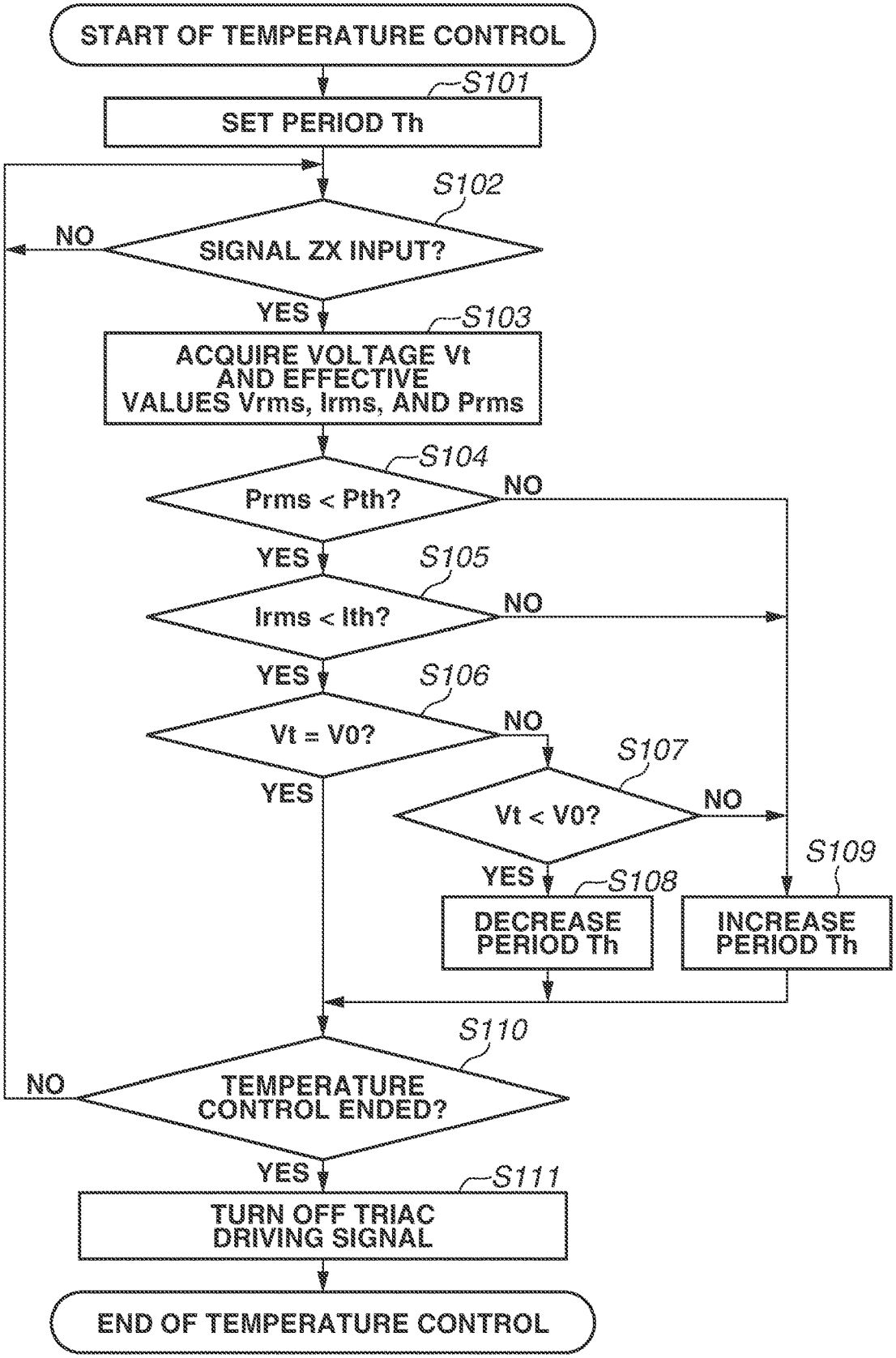
FIG. 6 is a flowchart illustrating a method of controlling the temperature of a fusing heater according to the first exemplary embodiment.

FIG. 6 is a flowchart illustrating the method of controlling the temperature of the fusing heater 161. In the following, the temperature control of the fusing heater 161 according to the present exemplary embodiment will be described with reference to FIG. 6. The processing in the flowchart is performed by the CPU 151*a*, for example, in response to an instruction input to start a job of the image forming apparatus 100.

In step S101, the CPU 151*a* sets a period Th based on, for example, a difference value between the voltage Vt acquired from the A/D converter 153 and a voltage V0 corresponding to a target temperature of the fusing heater 161, and notifies the control unit 165 of the period Th. As a result, the control unit 165 outputs an H-ON signal to the triac driving circuit 167*a* based on the set period Th and a zero cross timing.

In step S102, the CPU 151*a* receives a signal ZX from the control unit 165 (YES in step S102). In step S103, the CPU 151*a* acquires a voltage Vt output from the A/D converter 153 and the effective values Vrms, Irms, and Prms stored in the memory 165*a*.

In step S104, if the effective value Prms of power is greater than or equal to a threshold Pth (Prms≥Pth) (NO in step S104), the processing proceeds to step S109. In step S109, the CPU 151*a* outputs an instruction to increase the currently-set period Th to the control unit 165. The period Th may be increased by a predetermined amount, or determined based on the difference value between the effective value Prms and the threshold Pth.

As described above, when the effective value Prms of power is greater than or equal to the threshold Pth, a period Th set to make the effective value Prms less than the threshold Pth prevents excessive power from being supplied to the fusing heater 161. This prevents power consumption from increasing. It should be noted that the threshold Pth is set to a value greater than the power allowing the temperature of the fusing heater 161 to increase to the target temperature.

After that, the processing proceeds to step S110.

If the effective value Prms of the power is less than the threshold Pth (Prms<Pth) in step S104 (YES in step S104), the processing proceeds to step S105.

If the effective value Irms of the current is greater than or equal to a threshold Ith (Irms≥Ith) in step S105 (NO in step S105), the CPU 151*a* outputs an instruction to increase the currently-set period Th to the control unit 165 in step S109. The increasing amount of the period Th may be a previously determined amount or be determined based on the difference value between the effective value Irms and the threshold Ith.

As described above, for the effective value Irms greater than or equal to the threshold Ith, controlling the period Th to make the effective value Irms less than the threshold Ith makes it possible to prevent excessive current from being supplied to the heating element 161*a*. This prevents the temperature of the fusing heater 161 from excessively increasing. The threshold Ith is set to a value greater than a current increasing the temperature of the fusing heater 161 to the target temperature.

After that, the processing proceeds to step S110.

If the effective value Irms is less than the threshold Ith (Irms<Ith) in step S105 (YES in step S105), the processing proceeds to step S106.

If the voltage Vt acquired from the A/D converter 153 is equal to the voltage V0 corresponding to the target temperature of the fusing heater 161 in step S106 (YES in step S106), the processing proceeds to step S110.

In contrast, if the voltage Vt acquired from the A/D converter 153 is not equal to the voltage V0 corresponding to the target temperature of the fusing heater 161 in step S106 (NO in step S106), the processing proceeds to step S107.

If the voltage Vt is greater than the voltage V0 in step S107 (NO in step S107), in step S109, the CPU 151*a* outputs an instruction to increase the currently-set period Th to the control unit 165 to decrease the deviation between the voltage Vt and the voltage V0. The increasing amount of the period Th may be a previously determined amount or be determined based on the difference value between the voltage V0 and the voltage Vt.

If the voltage Vt is less than the voltage V0 in step S107 (YES in step S107), in step S108, the CPU 151*a* outputs an instruction to decrease the currently-set period Th to the control unit 165 to decrease the deviation between the voltage Vt and the voltage V0. The decreasing amount of the period Th may be a previously determined amount or be determined based on the difference value between the voltage V0 and the voltage Vt.

If the temperature control is continued (i.e., the print job is continued) in step S110 (NO in step S110), the processing returns to step S102.

If the temperature control ends (i.e., the print job ends) in step S110 (YES in step S110), the CPU 151*a* controls the control unit 165 to stop driving the triac 167 in step S111.

For variation in the power changed due to the increase of the period Th, for example, the varied amount with 100 V as the effective value of the voltage is different from that with 80 V as the effective value of the voltage. More specifically, the varied amount with 100 V as the effective value of the voltage is greater than that with 80 V as the effective value of the voltage. The CPU 151*a* controls the period Th based on the effective value Vrms of the voltage.

The method described above is a method of controlling the temperature of the fusing heater 161.

<Communication Between Detection Unit and Control Unit>

{Power Supply from Control Unit to Detection Unit}

Figure 7:
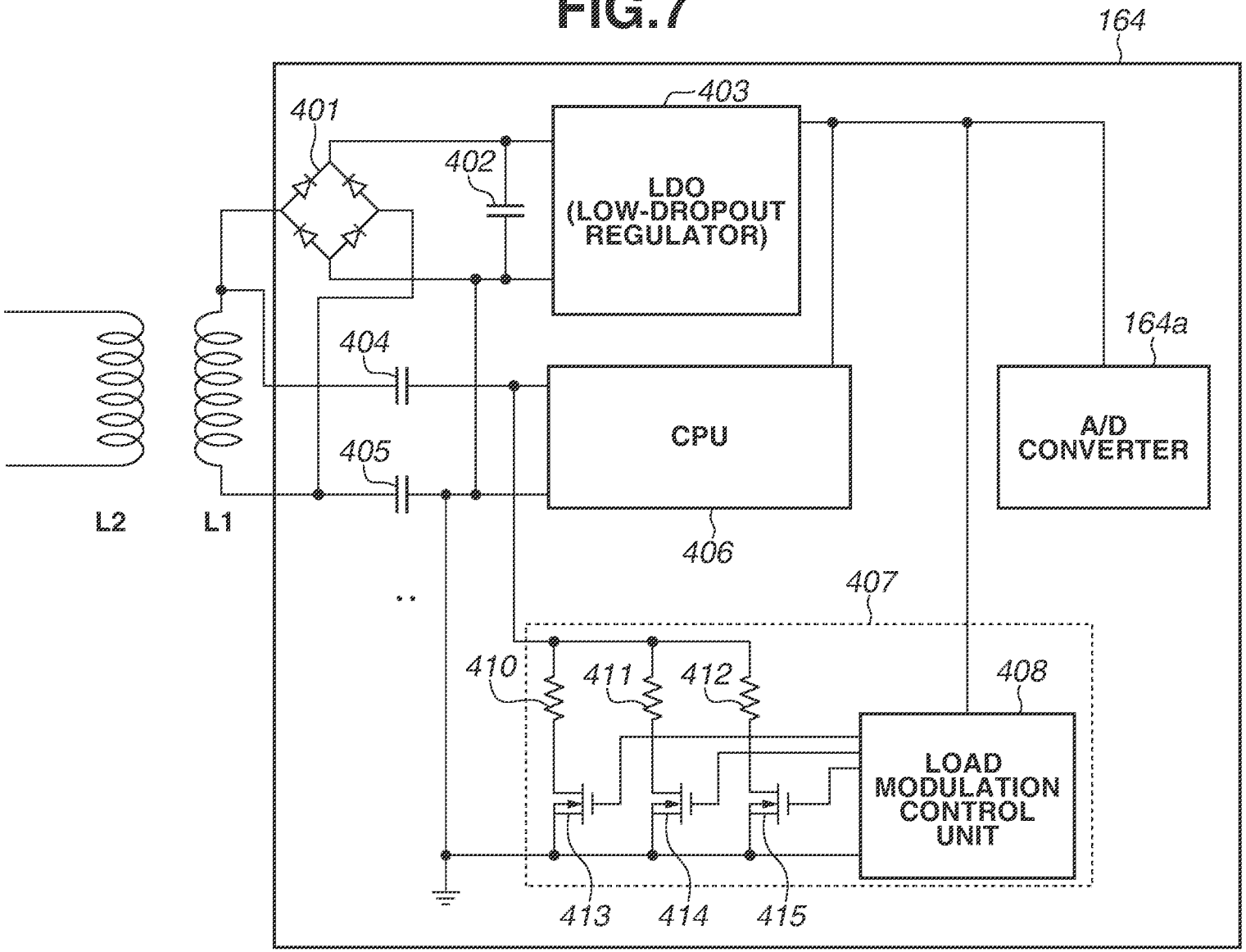
FIG. 7 is a block diagram illustrating a configuration of a detection unit.

FIG. 7 is a block diagram illustrating a configuration of the detection unit 164. The configuration of the detection unit 164 will be described with reference to FIG. 7. In FIG. 7, the resistors R1 to R3 are omitted.

The detection unit 164 in the first circuit 160*a* is insulated from the control unit 165 in the second circuit 160*b*, but is electromagnetically coupled to the control unit 165 via the antenna ANT including a coil (winding wire) L1 as a first communication unit and a coil (winding wire) L2 as a second communication unit. In some embodiments, capacitors are used in wireless communication between the first circuit 160*a* and the second circuit 160*b*, in place of the coils.

The control unit 165 outputs an amplitude-modulated high-frequency (e.g., 13.56 MHz) signal to the coil L2. If transmitting a command to the detection unit 164, the control unit 165 performs amplitude modulation on a carrier wave. The amplitude modulation will be described below.

The alternating current corresponding to the amplitude-modulated signal flows through the coil L2, and generates an alternating-current magnetic field at the coil L2, and the alternating-current magnetic field induces an alternating-current voltage in the coil L1.

As illustrated in FIG. 7, both ends of the coil L1 are connected to alternating-current terminals of a bridge diode 401 as a rectification unit to rectify an alternating current generated by the alternating-current voltage generated in the coil L1. A smoothing capacitor 402 and a low-dropout regulator (LDO) 403 are connected to rectification terminals of the bridge diode 401.

The smoothing capacitor 402 as a power storage unit is charged by the voltage generated in the coil L1.

The LDO 403 supplies a current smoothed by the bridge diode 401 and the smoothing capacitor 402 to a CPU 406, a load modulation control unit 408, and the A/D converter 164*a*.

As described above, in the present exemplary embodiment, power is supplied from the control unit 165 to the detection unit 164 via the antenna ANT. This allows no power supply operating the detection unit 164 in the first circuit 160*a* to be provided, preventing the upsizing of the apparatus and cost increase. During a period that the image forming apparatus 100 is at a sleep status, the control unit 165 may not supply power to the detection unit 164.

{Transmission/Reception of Command}

Figure 8:
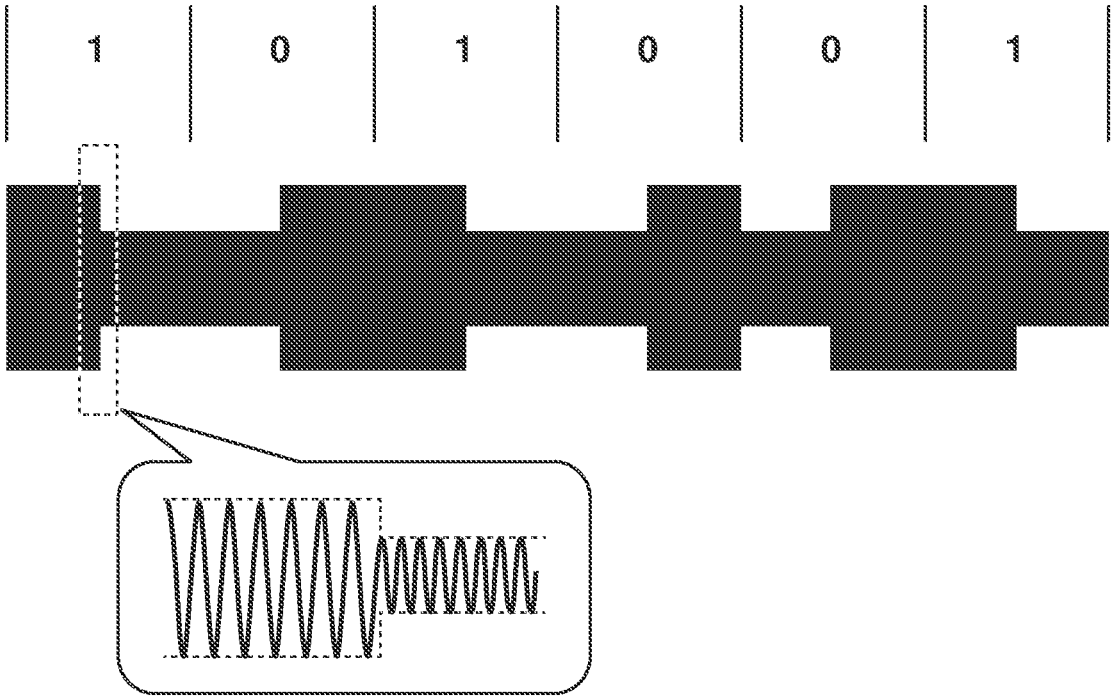
FIG. 8 is a diagram illustrating an amplitude-modulated wave.

To transmit a command to the detection unit 164, the control unit 165 performs amplitude modulation on a carrier wave. FIG. 8 is a diagram illustrating amplitude-modulated signals. As illustrated in FIG. 8, a signal representing '0' and '1' are represented by a combination of a signal with a first amplitude and a signal with a second amplitude smaller than the first amplitude. For example, the first half of one bit of a signal representing '1' is represented by the signal with the first amplitude, and the latter half of one bit of the signal representing '1' is represented by the signal with the second amplitude. Further, the first half of one bit of a signal representing '0' is represented by the signal with the second amplitude, and the latter half of one bit of the signal representing '0' is represented by the signal with the first amplitude. The control unit 165 transmits a command to the detection unit 164 by generating the signal representing '0' and '1' as illustrated in FIG. 8.

As illustrated in FIG. 7, both ends of the coil L1 are connected to coupling capacitors 404 and 405. The terminals of the coupling capacitors 404 and 405 remote from the coil L1 are connected to the CPU 406.

The CPU 406 reads the command transmitted from the control unit 165 based on the amplitude of the signal input via the coupling capacitors 404 and 405.

The CPU 406 notifies the control unit 165 that the CPU 406 has read the command by a method that will be described below. Then, the CPU 406 performs the operation according to the read command.

As described above, in the present exemplary embodiment, the control unit 165 transmits the command to the detection unit 164 by performing the amplitude modulation on the carrier wave.

{Data Transmission from Detection Unit to Control Unit}

As illustrated in FIG. 7, the coupling capacitors 404 and 405 are connected to a load modulation circuit 407 as a transmission unit.

The load modulation circuit 407 includes resistors 410, 411, and 412, field-effect transistors (FETs) 413, 414, and 415, and the load modulation control unit 408 controlling the states on and off of each of the FETs. In the present exemplary embodiment, a resistance value Ra of the resistor 410 is 700Ω, a resistance value Rb of the resistor 411 is 500Ω, and a resistance value Rc of the resistor 412 is 300Ω; however, the resistance values of the respective resistors are not limited thereto.

The load modulation control unit 408 modulates the impedance of the circuitry connected to the coil L1 by controlling the states on and off of each of the FETs 413, 414, and 415 based on data to be transmitted to the control unit 165. The configuration described with reference to FIG. 8 is employed in data transmission by the amplitude modulation.

The control unit 165 detects the amplitude of a current flowing through the coil L2 according to the variation of the amplitude of the current flowing through the coil L1 to read the data transmitted from the detection unit 164. The data transmitted from the detection unit 164 includes a signal ZX representing a zero cross timing, an effective value Vrms of the voltage V, an effective value Irms of the current I, an effective value Prms of the power V*I(=P), and a notification representing the reception of a command from the control unit 165.

Thus, the detection unit 164 transmits data to the electromagnetically coupled control unit 165 via the antenna ANT. In other words, the detection unit 164 transmits the data to the control unit 165 through wireless communication between the coil L1 and the coil L2.

{Control in Detection of Current and Voltage}

Next, the control will be described in detection of current and voltage. In the present exemplary embodiment, the following configuration prevents power supplied to a load from becoming unstable.

Figure 9:
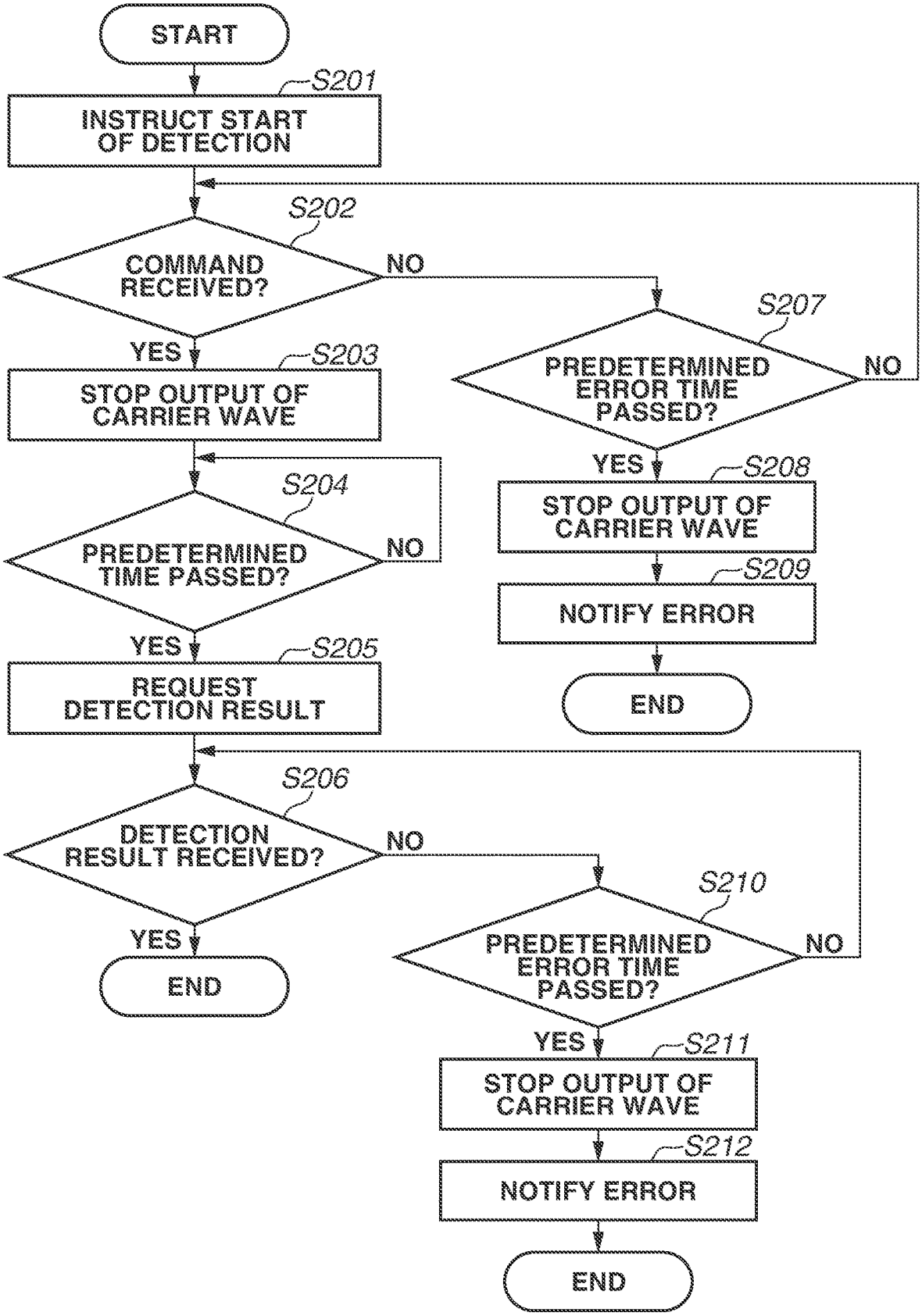
FIG. 9 is a flowchart illustrating the operation of the control unit to acquire a detection result of the detection unit.

FIG. 9 is a flowchart illustrating an operation of the control unit 165 to acquire a detection result of the detection unit 164. The processing in the flowchart is performed by the control unit 165 every predetermined control period.

In step S201, the control unit 165 transmits an instruction to start detection of the current I and the voltage V to the detection unit 164 via the coils L2 and L1.

If a notification that the detection unit 164 has received the instruction (command) is not issued from the detection unit 164 in step S202 (NO in step S202), the processing proceeds to step S207.

If a predetermined error period has not passed in step S207 (NO in step S207), the processing returns to step S202.

If the predetermined error time has passed in step S207 (YES in step S207), the control unit 165 stops the supply of power to the detection unit 164 in step S208.

After that, in step S209, the control unit 165 notifies the CPU 151*a* that the predetermined error time has passed. The CPU 151*a* displays information representing the occurrence of the error in the AC driver 160 on the display unit of the operation unit 152 to notify the user of the information.

If the notification that the detection unit 164 has received the instruction (command) is issued from the detection unit 164 in step S202 (YES in step S202), the control unit 165 stops the output of the carrier wave to the coil L2 in step S203. In other words, the power supply from the control unit 165 to the detection unit 164 is stopped.

Next, if a predetermined period has passed in step S204 (YES in step S204), the control unit 165 transmits a command (request signal) requesting the detection result to the detection unit 164 via the coils L2 and L1 in step S205. The predetermined period is previously set to a period enabling the A/D converter 164*a* to convert the current I and the voltage V from the analog values in the half period or more of the alternating-current voltage into digital values. In addition, the predetermined period set is shorter than the period that the detection unit 164 is operable on the power stored in the smoothing capacitor 402.

If the control unit 165 has received no detection result from the detection unit 164 in step S206 (NO in step S206), the processing proceeds to step S210.

If the predetermined error period has not passed in step S210 (NO in step S210), the processing returns to step S206.

If the predetermined error period has passed in step S210 (YES in step S210), the control unit 165 stops the supply of power to the detection unit 164 in step S211.

After that, in step S212, the control unit 165 notifies the CPU 151*a* that the predetermined error period has passed. The CPU 151*a* displays information representing the occurrence of the error in the AC driver 160 on the display unit of the operation unit 152 to notify the user of the information.

If the control unit 165 has received the detection result (i.e., an effective value Vrms of voltage V, an effective value Irms of current I, an effective value Prms of power V*I(=P), and a signal ZX) from the detection unit 164 in step S206 (YES in step S206), the processing in the flowchart ends.

Figure 10:
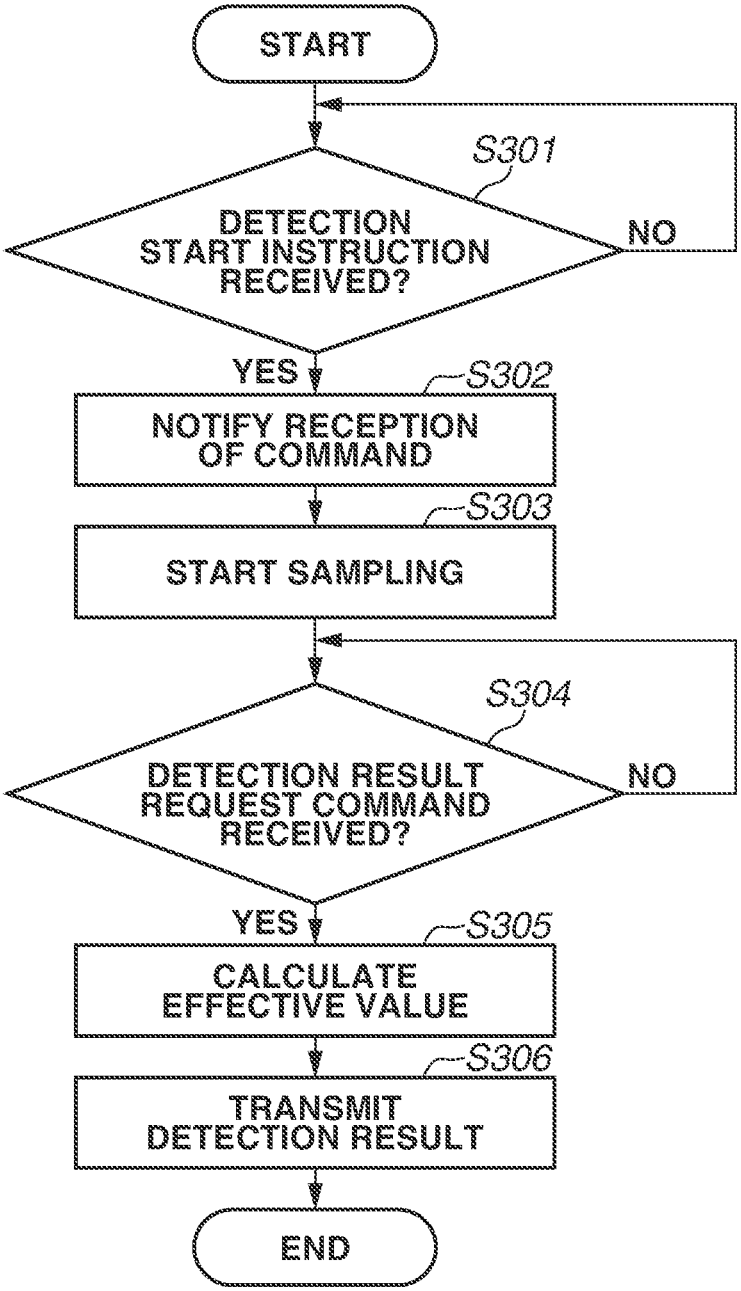
FIG. 10 is a flowchart illustrating the operation of the detection unit.

FIG. 10 is a flowchart illustrating operation of the detection unit 164. The processing in the flowchart is performed by the CPU 406.

In response to the reception of the instruction to start detection of the current I and the voltage V in step S301 (YES in step S301), the detection unit 164 notifies the control unit 165 of the reception of the instruction (command) in step S302. As a result, the power supply from the control unit 165 to the detection unit 164 is stopped, and the detection unit 164 operates on the power stored in the smoothing capacitor 402.

Next, in step S303, the detection unit 164 starts sampling the current I and the voltage V.

After that, in response to the reception of the command to request the detection result in step S304 (YES in step S304), the detection unit 164 calculates the effective value Vrms of the voltage V, the effective value Irms of the current I, and the effective value Prms of the power V*I(=P) in step S305.

In step S306, the detection unit 164 transmits the effective values calculated in step S305 and a zero cross timing signal ZX as the detection result to the control unit 165.

As described above, in the present exemplary embodiment, no carrier wave is output from the control unit 165 during the period that the detection unit 164 detects the current I and the voltage V. In other words, during the period that the detection unit 164 detects the current I and the voltage V, the power supply from the control unit 165 to the detection unit 164 is not performed, and the detection unit 164 operates on the power stored in the smoothing capacitor 402 (power discharged from the smoothing capacitor 402). This prevents A/D conversion accuracy (power detection accuracy) from being deteriorated due to the electromagnetic wave of a carrier wave. In other words, this prevents power supplied to a load from becoming unstable.

In the present exemplary embodiment, in response to the reception of the instruction to start detection of the current I and the voltage V, the detection unit 164 (A/D converter 164*a*) converts analog values of the voltage V and the current I into digital values; however, the conversion timing is not limited thereto. For example, the detection unit 164 may convert analog values of the voltage V and the current I into digital values before receiving the instruction to start detection of the current I and the voltage V. In this case, in response to reception of the instruction to start detection of the current I and the voltage V, the detection unit 164 uses as the detection result a result of conversion performed after receiving the instruction.

In the present exemplary embodiment, during the period that the detection unit 164 detects the current I and the voltage V, the detection unit 164 operates on the power stored in the smoothing capacitor 402; however, the operation of the detection unit 164 is not limited thereto. For example, the detection unit 164 may operate on power stored in a capacitor separately provided for storing power caused by a carrier wave during the period that the detection unit 164 detects the current I and the voltage V.

In the present exemplary embodiment, the control unit 165 provided in the second circuit 160*b* controls the triac 167; however, the control of the triac 167 is not limited thereto. For example, the detection unit 164 provided in the first circuit 160*a* may have a configuration controlling the triac 167.

The control unit 165 may have the functionality of the CPU 151*a* in the present exemplary embodiment, or the CPU 151*a* may have the functionality of the control unit 165.

The voltage V, the current I, and other values in the present exemplary embodiment are parameters relating to the power supplied to a load.

Further, the triac driving circuit 167*a* and the triac 167 in the present exemplary embodiment are respectively included in an adjustment unit and a triac circuit.

Furthermore, in the present exemplary embodiment, the power supplied to the heating element 161*a* is adjusted by the triac 167; however, a configuration adjusting the power is not limited thereto. For example, the power supplied to the heating element 161*a* may be adjusted by changing the resistance of the first circuit 160*a* to modulate the amplitudes of the voltage and the current supplied to the heating element 161*a*.

Furthermore, in the present exemplary embodiment, near field communication (NFC) is used as a method of performing wireless communication between the detection unit 164 and the control unit 165; however, the method of performing wireless communication between the detection unit 164 and the control unit 165 is not limited thereto. For example, a method such as infrared communication may be used as a method of performing wireless communication between the detection unit 164 and the control unit 165.

Furthermore, in the present exemplary embodiment, the first circuit 160*a* is connected to commercial power supply; however, the power supply is not limited thereto. For example, the first circuit 160*a* may be connected to a predetermined power supply such as a battery.

In the exemplary embodiment of the present invention, power supplied to a load is prevented from becoming unstable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-109836, filed Jun. 25, 2020, which is hereby incorporated by reference herein in its entirety.

What is claimed is:

1. A power supply device including a first circuit connected to a predetermined power supply and a second circuit insulated from the first circuit, the power supply device comprising:

an adjustment unit in the first circuit and configured to adjust power supplied from the predetermined power supply to a load;

a detection unit in the first circuit and configured to detect values of parameters relating to the power supplied to the load;

a processing unit in the first circuit and including a conversion unit configured to convert the detected values of the parameters from analog values into digital values at predetermined time intervals;

a first communication unit in the first circuit and connected to the processing unit;

a second communication unit in the second circuit, insulated from the first communication unit, and configured to perform wireless communication with the first communication unit;

a control unit in the second circuit, connected to the second communication unit, and configured to output a carrier wave used in the wireless communication to the second communication unit; and a power storage unit in the first circuit and configured to store power generated in the first communication unit and caused by the carrier wave, wherein, after the control unit outputs the carrier wave during a first period, the control unit stops output of the carrier wave during a second period, wherein, during the second period, the conversion unit operates on the power stored in the power storage unit during the first period, wherein the control unit outputs the carrier wave during a third period after the second period, wherein, during the third period, the processing unit transmits information about a conversion result by the conversion unit during the second period, to the control unit through the wireless communication between the first communication unit and the second communication unit, and wherein the control unit controls the adjustment unit based on the transmitted information.

2. The power supply device according to claim 1, wherein, during the third period, the control unit transmits a request signal representing a request for the information, to the processing unit by using the carrier wave, and wherein, in response to reception of the request signal, the processing unit transmits the information to the control unit during the third period.

3. The power supply device according to claim 2, wherein the processing unit includes a storage unit configured to store the digital values converted by the conversion unit, wherein, in response to reception of the request signal, the processing unit calculates effective values of the parameters during the third period, based on the digital values converted by the conversion unit during the second period and stored in the storage unit, and wherein the processing unit transmits, as the information, information representing the calculated effective values to the control unit.

4. The power supply device according to claim 1, wherein the second period has a length set to a period longer than a period that the conversion unit converts the analog values for a half period or more of an alternating-current voltage supplied from the predetermined power supply.

5. The power supply device according to claim 1, wherein the second period has a length set to a period shorter than a period that the processing unit is operable on the power stored in the power storage unit.

6. The power supply device according to claim 1, further comprising a rectification unit in the first circuit and configured to rectify the power generated in the first communication unit and caused by the carrier wave, wherein, during the third period, the processing unit operates on the rectified power.

7. The power supply device according to claim 6, wherein the power storage unit is a capacitor smoothing the rectified power.

8. The power supply device according to claim 1, wherein the power storage unit is a capacitor.

9. The power supply device according to claim 1, wherein the first communication unit includes a first antenna including a winding wire, wherein the second communication unit includes a second antenna including a winding wire, and wherein the wireless communication between the first communication unit and the second communication unit is performed with the first antenna and the second antenna.

10. The power supply device according to claim 9, wherein the first communication unit includes a transmission unit configured to transmit the information by controlling impedance of the winding wire included in the first antenna.

11. The power supply device according to claim 9, wherein the processing unit transmits the information to the control unit using a signal of a voltage induced in the first antenna, the signal caused by the carrier wave.

12. The power supply device according to claim 1, further comprising:

a light emitting device in the second circuit and configured to emit light;

a light receiving device in the first circuit and configured to receive the emitted light; and a driving unit in the first circuit and configured to drive the adjustment unit based on the light reception by the light receiving device, wherein the control unit controls the adjustment unit by controlling the light emission from the light emitting device.

13. The power supply device according to claim 1, wherein the carrier wave corresponds to an alternating-current voltage.

14. The power supply device according to claim 1, wherein the adjustment unit is a triac circuit, and wherein the control unit increases a duration that the triac circuit is in an on state to increase the power supplied to the load, and decreases the duration that the triac circuit is in the on state to decrease the power supplied to the load.

15. The power supply device according to claim 1, wherein the first communication unit and the second communication unit perform the wireless communication by near field communication (NFC).

16. The power supply device according to claim 1, wherein the predetermined power supply is a commercial power supply.

17. The power supply device according to claim 1, wherein the detection unit includes a resistor.

18. An image forming apparatus, comprising:

a power supply device including a first circuit connected to a predetermined power supply and a second circuit insulated from the first circuit;

a heater;

a first detection unit configured to detect a temperature of the heater;

a transfer unit configured to transfer a toner image to a sheet; and a fusing unit configured to fuse the transferred toner image to the sheet by heat of the heater, wherein the power supply device includes:

an adjustment unit in the first circuit and configured to adjust power supplied from the predetermined power supply to a load;

a second detection unit in the first circuit and configured to detect values of parameters relating to the power supplied to the load;

a processing unit in the first circuit and including a conversion unit configured to convert the detected values of the parameters from analog values into digital values at predetermined time intervals;

a first communication unit in the first circuit and connected to the processing unit;

a second communication unit in the second circuit, insulated from the first communication unit, and configured to perform wireless communication with the first communication unit;

a control unit in the second circuit, connected to the second communication unit, and configured to output a carrier wave used in the wireless communication to the second communication unit; and a power storage unit in the first circuit and configured to store power generated in the first communication unit and caused by the carrier wave, wherein, after the control unit outputs the carrier wave during a first period, the control unit stops output of the carrier wave during a second period, wherein, during the second period, the conversion unit operates on the power stored in the power storage unit during the first period, wherein the control unit outputs the carrier wave during a third period after the second period, wherein, during the third period, the processing unit transmits information about a conversion result by the conversion unit during the second period to the control unit through the wireless communication between the first communication unit and the second communication unit, and wherein the control unit controls the adjustment unit based on the transmitted information to decrease a deviation between a target temperature of the heater and the temperature detected by the first detection unit.

* * * * *